US005309807A

United States Patent [19]

Kingma

[11] Patent Number: 5,309,807

[45] Date of Patent: May 10, 1994

[54] FLUTE

[76] Inventor: Eva K. Kingma, Hoofdstraat 10, 944 PB Grolloo, Netherlands

[21] Appl. No.: 959,925

[22] Filed: Oct. 14, 1992

Related U.S. Application Data

[63] Continuation-in-part of Ser. No. 558,872, Jul. 30, 1990, abandoned.

[51] Int. Cl.[5] ..... G10D 7/02

[52] U.S. Cl. ..... 84/384

[58] Field of Search ..... 84/380 R, 380 A, 380 C, 84/382, 384, 385 R, 385 P

[56] References Cited

U.S. PATENT DOCUMENTS

| | | | |
|---|---|---|---|
| 527,742 | 10/1894 | Devault | 84/382 |
| 638,385 | 12/1899 | Evette | 84/382 |
| 3,890,874 | 6/1975 | Vedder | 84/384 |

*Primary Examiner*—Michael L. Gellner

*Assistant Examiner*—Cassandra Spyrou

*Attorney, Agent, or Firm*—Foley & Lardner

[57] ABSTRACT

A flute has a tubular body having a plurality of openings therein, a plurality of flaps, a secondary flap, and mechanisms for moving each of the plurality of flaps and the secondary flap. The plurality of flaps can be moved into and out of engagement with a respective one of the tubular body openings, and at least one of the plurality of flaps is an annular flap which has an opening therein. The annular flap can be moved independent from the secondary flap and the rest of the plurality of flaps into and out of engagement with a respective one of the tubular body openings such that the respective one of the tubular body openings is partially closed and opened, respectively. Moreover, the secondary flap can be independently moved from the plurality of flaps into and out of engagement with the annular flap opening such that the annular flap opening is closed and opened, respectively.

3 Claims, 1 Drawing Sheet

FLUTE

CROSS-REFERENCE TO RELATED APPLICATIONS

This application is a continuation-in-part of U.S. Ser. No. 07/558,872 which was filed on Jul. 30, 1990, now abandoned.

BACKGROUND OF THE INVENTION

The invention relates to a flute, and in particular a bass flute which is provided with a number of openings over its length, at least some of which may be closed by means of flaps.

SUMMARY OF THE INVENTION

An object of the invention is to increase the number of sound characteristics which can be produced by a flute without negatively impacting the ability of the user to easily play the flute. Sound characteristics are understood as being the number of harmonics which are produced at a given note.

In accordance with one aspect of the invention, the number of sound characteristics is increased by providing a flute wherein at least some of the flaps are an annular flap, which means that these flaps are provided with a central opening. The diameter of the central opening is smaller than a corresponding diameter in the body of the flute. Thus, the opening in the flute can be partially closed by moving the annular flap into the opening in the flute. In addition, further sound variations can be obtained by either opening or closing the opening in the annular flap.

In addition, since using a finger as the mechanism for the purpose of closing the opening in the annular flap often presents physiological difficulties, the inventive apparatus provides a secondary flap which can be moved into the opening of the annular flap in order to close that opening. The secondary flap is provided with a control that is positioned near a control for moving the annular flap so that the control for moving the annular flap and the control for moving the secondary flap can be easily operated by using the same finger.

In addition, in order to produce a very wide range of harmonics, the means for moving the annular flap allows the annular flap to be moved independently from the secondary flap as well as any other flaps which may be disposed on the flute body. Moreover, the control for moving the secondary flap allows the secondary flap to be independently moved into and out of engagement with the annular flap opening such that the secondary flap can be moved independently from any other flaps, including the annular flap.

BRIEF DESCRIPTION OF THE DRAWINGS

The invention is further described by means of an embodiment shown in the drawings, wherein.

DETAILED DESCRIPTION OF THE PREFERRED EMBODIMENTS

Figure 1:
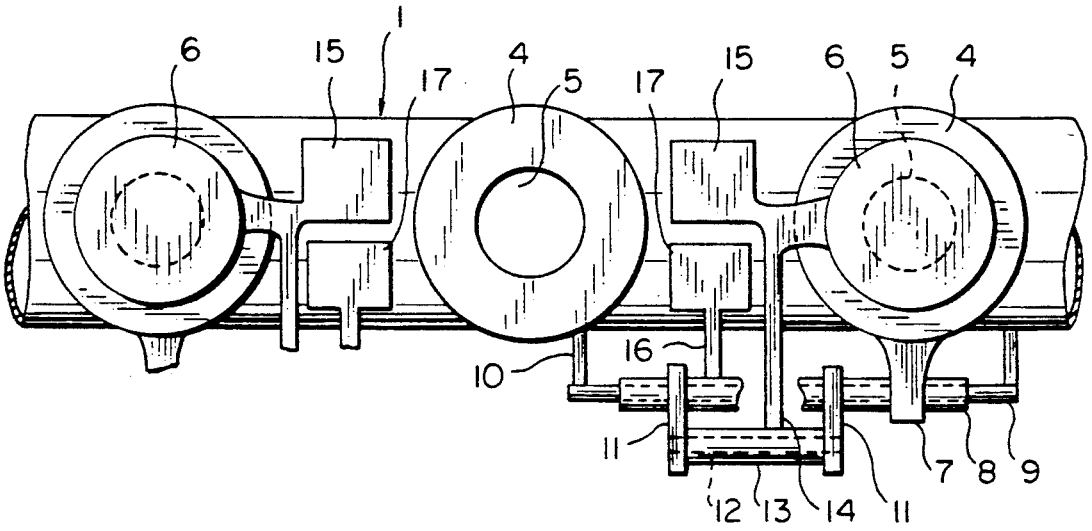
FIG. 1 is a schematic plan view of a part of a bass flute having three annular flaps, the two outwardly positioned flaps being provided with a secondary flap.
Figure 2:
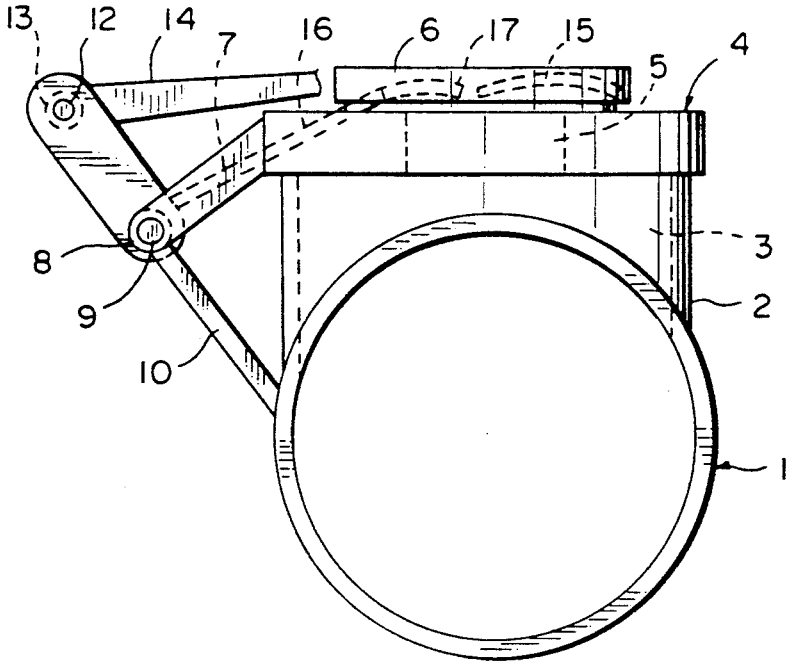
FIG. 2 is a schematic end view of the bass flute of FIG. 1.

The cylindrical part 1 of a bass flute shown in the drawings is provided with collars 2 having openings 3 therein which may be partially closed by means of the annular flaps 4. Each of the annular flaps 4 is provided with a central opening 5. Thus, when the annular flap 4 is moved into the opening 3, the opening 3 is partially closed because the opening 5 is smaller in diameter than the opening 3. As shown in FIG. 1, secondary flaps 6 are provided proximate the outwardly lying annular flaps 4. The secondary flap 6 can be moved into a position such that it closes the opening 5 in the annular flap 4.

The annular flaps 4 are each supported by an arm 7 that is connected to a tube 8, with tube 8 being pivotally supported by means of a shaft 9. The shaft 9 is connected to the cylindrical part 1 of the flute by means of supports 10.

Two supports are provided on tube 8 and are connected to a shaft 12 on which a tube 13 is pivotally supported. The tube 13 is connected to one end of an arm 14, the other end of which is connected to the secondary flap 6. The arm 14 is also connected to the key 15 which is used to control the movement of the secondary flap 6. The tube 8 is connected to the key 17 by means of an arm 16. Thus, the movement of the annular flap 4 is controlled via the key 17.

Keys 15 and 17 are located such that both keys can be easily controlled by one finger so that the corresponding annular flap 4 and the secondary flap 6 can also be controlled by the one finger.

In the case of the embodiment shown in the drawings, the annular flap 4 and the secondary flap 6 are biased to an open position by means of springs (not shown). However, the secondary flap 6 and the annular flap 4 can be closed by means of the keys 15 and 17, respectively. That is, annular flap 4 can be moved into and out of opening 3 by pressing down on and releasing key 17, respectively. Moreover, secondary flap 6 can be moved into a position to close opening 5 of annular flap 4 or to a position such that opening 5 is not closed by secondary flap 6 by depressing and releasing, respectively, key 15. Therefore, an increased number of harmonics can be produced because the annular flap 4 and the secondary flap 6 can be moved independently from each other as well as independently from any other flaps in the flute.

Therefore, due to the independent movement of secondary flap 6, and annular flap 4, via keys 15 and 17, respectively, it is possible that both flaps may both be in an open position (openings 3 and 5 left open), or one of these flaps can be in a closed position and the other open (one of openings 3 and 5 closed with the other of openings 3 and 5 open), or both flaps may be in a closed position (openings 3 and 5 closed).

It is also possible that the annular flap 4 and the secondary flap 6 can be biased to a closed position by means of springs and in this case, the keys 15 and 17 would be arranged in such a way that the secondary flap 6 and the annular flap 4 can be brought into the open position against the biasing force of the springs.

It is to be understood that the foregoing detailed description, while indicating preferred embodiments of the present invention are given by way of illustration and not limitation. Many changes and modifications within the scope of the present invention may be made without departing from the spirit thereof, and the invention includes all such modifications.

What is claimed is:

1. A flute comprising:

a tubular body having a plurality of openings therein;

a plurality of flaps each of which move into and out of engagement with a respective one of said tubular body openings, wherein at least one of said plurality of flaps is an annular flap having an opening therein;

a secondary flap movable into and out of engagement with said annular flap opening;

a first means for moving said annular flap independently from said secondary flap and said plurality of flaps into and out of engagement with said respective one of said tubular body openings such that said respective one of said tubular body openings is partially closed and opened, respectively; and a second means for moving said secondary flap, independently of said plurality of flaps including independently of said annular flap, into and out of engagement with said annular flap opening such that said annular flap opening is closed and opened, respectively.

2. A flute according to claim 1, wherein a diameter of said tubular body opening is larger than a diameter of said annular flap opening.

3. A flute according to claim 3, wherein said first and second means are positioned such that both said first and second means can be operated by a single finger.

* * * * *